US009850676B2

(12) United States Patent
Hamilton

(10) Patent No.: US 9,850,676 B2
(45) Date of Patent: Dec. 26, 2017

(54) LEVEL ADJUSTMENT TOOL, SYSTEM AND METHOD FOR FREE STANDING POLES AND STRUCTURAL COLUMNS

(71) Applicant: Kendal G. Hamilton, Menifee, CA (US)

(72) Inventor: Kendal G. Hamilton, Menifee, CA (US)

( * ) Notice: Subject to any disclaimer, the term of this patent is extended or adjusted under 35 U.S.C. 154(b) by 0 days.

(21) Appl. No.: 14/508,597

(22) Filed: Oct. 7, 2014

(65) Prior Publication Data

US 2015/0135610 A1 May 21, 2015

Related U.S. Application Data

(63) Continuation of application No. 12/025,245, filed on Feb. 4, 2008, now abandoned.

(60) Provisional application No. 60/900,002, filed on Feb. 6, 2007.

(51) Int. Cl.
*E04H 12/22* (2006.01)
*E02D 27/42* (2006.01)

(52) U.S. Cl.
CPC ..... *E04H 12/2284* (2013.01); *E02D 27/42* (2013.01); *E04H 12/2261* (2013.01)

(58) Field of Classification Search
CPC .. E04H 12/2284; E04H 12/2261; E02D 27/42
USPC ..... 81/488; 7/164, 170; 33/1 BB, 333, 334, 33/365, 370, 390; 52/126.1, 126.3, 126.4, 52/126.7, 295, 296, 745.17, 745.19, 52/741.1, 749.1, DIG. 1; 248/550, 248/346.05; 362/253, 382, 418, 431
See application file for complete search history.

(56) References Cited

U.S. PATENT DOCUMENTS

| | | | | | |
|---|---|---|---|---|---|
| 1,423,529 | A | * | 7/1922 | King et al. | 33/378 |
| 2,763,342 | A | * | 9/1956 | French | 403/25 |
| 3,311,333 | A | * | 3/1967 | Galloway | 52/295 |
| 3,521,413 | A | * | 7/1970 | Scott et al. | 52/98 |
| 3,645,057 | A | * | 2/1972 | Kaplan | 52/295 |
| 3,671,738 | A | * | 6/1972 | Beachley | 362/431 |
| 3,785,097 | A | * | 1/1974 | Seymour | 52/126.7 |
| 4,194,237 | A | * | 3/1980 | Conklin | 362/253 |
| 4,295,308 | A | * | 10/1981 | Korfanta | 52/296 |
| 4,603,526 | A | * | 8/1986 | Bollmann | E02D 27/42 403/86 |
| 4,878,160 | A | * | 10/1989 | Reneau et al. | 362/269 |
| 5,404,682 | A | * | 4/1995 | West | A47G 29/1216 248/183.1 |
| 5,505,033 | A | * | 4/1996 | Matsuo et al. | 52/296 |
| 5,740,645 | A | * | 4/1998 | Raby | 52/297 |

(Continued)

FOREIGN PATENT DOCUMENTS

| | | | | | |
|---|---|---|---|---|---|
| JP | 05214731 | A | * | 8/1993 | E02D 27/00 |
| JP | 2006264803 | A | * | 10/2006 | B66B 7/00 |

*Primary Examiner* — Brent W Herring
(74) *Attorney, Agent, or Firm* — Slater Hersey & Lieberman, LLP; Sandra P. Thompson

(57) ABSTRACT

A removable tool for leveling a vertical structure in a vertically level orientation is also disclosed, the tool including a flat substantially non-bendable material, wherein the tool has a central hole formed in the center thereof that does not extend to or open out to the periphery of the tool, and four slots extending radially away from the hole and spaced from each other evenly about the tool. Contemplated systems and methods for utilizing the removable tool are also disclosed herein.

5 Claims, 9 Drawing Sheets

(56) References Cited

U.S. PATENT DOCUMENTS

| | | | | | |
|---|---|---|---|---|---|
| 5,836,132 | A * | 11/1998 | Weathersby | 52/702 | |
| 5,878,540 | A * | 3/1999 | Morstein | 52/296 | |
| 5,927,677 | A * | 7/1999 | Speece | E04H 12/2215 | 248/516 |
| RE36,550 | E * | 2/2000 | West | A47G 29/1216 | 248/183.1 |
| 6,141,928 | A * | 11/2000 | Platt | 52/296 | |
| 6,216,414 | B1 * | 4/2001 | Feldberg | 248/525 | |
| 6,273,390 | B1 * | 8/2001 | Meyer | E04H 12/2284 | 248/507 |
| 6,568,095 | B2 * | 5/2003 | Snyder | 33/370 | |
| 6,618,953 | B2 * | 9/2003 | Izumi | E04H 12/2284 | 248/514 |
| 6,722,821 | B1 * | 4/2004 | Perko et al. | 405/249 | |
| 6,820,389 | B1 * | 11/2004 | Macchietto | E04C 3/32 | 248/156 |
| 6,868,641 | B2 * | 3/2005 | Conner et al. | 52/98 | |
| 7,219,873 | B2 * | 5/2007 | Harwood | E04H 12/2261 | 181/171 |
| 7,360,315 | B2 * | 4/2008 | Knepp | E02D 5/38 | 33/370 |
| 7,533,506 | B2 * | 5/2009 | Platt | 52/296 | |
| 7,766,299 | B2 * | 8/2010 | Titus et al. | 248/577 | |
| 7,886,492 | B2 * | 2/2011 | Kelly et al. | 52/297 | |
| 8,226,354 | B2 * | 7/2012 | Nies | E02D 33/00 | 415/118 |
| 2003/0126751 | A1 * | 7/2003 | Izumi | E04F 11/1812 | 33/333 |
| 2005/0285011 | A1 * | 12/2005 | Harwood | 248/519 | |
| 2006/0022189 | A1 * | 2/2006 | Collins, IV | 256/65.14 | |
| 2008/0190058 | A1 * | 8/2008 | Migliore | 52/295 | |
| 2009/0272053 | A1 * | 11/2009 | Dent | 52/296 | |
| 2010/0205875 | A1 * | 8/2010 | Rawson-Harris | 52/126.7 | |
| 2013/0061453 | A1 * | 3/2013 | Rosendahl | 29/525.11 | |

* cited by examiner

LEVEL ADJUSTMENT TOOL, SYSTEM AND METHOD FOR FREE STANDING POLES AND STRUCTURAL COLUMNS

This United States Continuation Application claims priority to U.S. Utility patent application Ser. No. 12/025,245 (US Patent Publication 2008/0184633) entitled "Level Adjustment System and Method for Free Standing Poles and Structural Columns" that was filed on Feb. 4, 2008 and claims priority to U.S. Provisional Application Ser. No. 60/900,002 filed on Feb. 17, 2007, both of which are commonly-owned and incorporated by reference in their entirety.

FIELD OF THE SUBJECT MATTER

The subject matter disclosed herein is related to leveling vertically standing poles and columns, and more particularly to a system, apparatus/tool and method of utilizing that tool that utilizes nuts vertically adjustable on bolts to level or to provide a level support for such poles and columns.

BACKGROUND

In the prior art, poles are generally leveled by installing four bolts in a concrete base spaced from each other as are the mounting holes in the base of the pole. Nuts with washers over them are then installed on each of the bolts. The nuts on pairs of bolts are then successively vertically adjusted so they are level with each other with a Torpedo level which is placed between two nuts. This type of leveling operation is repeated with different pairs of nuts until all are indicated to be in a level state. The base of the pole is then mounted on the bolts and additional leveling is done. This is a rather tedious and time consuming operation and is readily subject to errors.

U.S. Pat. No. 4,194,237 issued on Conklin discloses bolts that are designed to make the pole "break-a-way". This is very important, because there is nothing in Conklin that would lead one of ordinary skill in the art to consider a non-break-a-way pole and leveling a pole that is not designed to break away. In the Conklin reference, the bolts that are originally installed in the foundation base do not fit through the apertures in the light pole base. In Conklin, the bolts that are originally installed in the foundation base are coupled to a "break-a-way" coupling providing a gap between the foundation base bolts and the pole base coupling, so that when a car hits the pole—the pole breaks off and falls away from the car. The foundation bolts do not fit through the apertures in the vertical structure base.

Therefore, there is a need for a level system that is simple to use, removable and able to level a pole on a support base.

SUMMARY OF THE SUBJECT MATTER

A contemplated system has four threaded bolts, which are installed in a concrete block with their threaded portions protruding upwardly above the surface of the block. The bolts are positioned in a circular configuration spaced equally from each other around the block. A nut is installed on each of the bolts and a washer may be installed over each bolt between the nut and the bolt. A plate which serves as a removable tool is fabricated of a rigid material which may be of aluminum and is thick enough to resist bending. The tool plate has a central aperture and four slots equally spaced from each other which run from the central aperture towards the periphery of the plate. Each of the bolts is fitted into a separate one of said slots with the edges of each slot being supported either directly on the bolt or on a washer fitted on the bolt. A leveling gage is mounted on the plate. The nuts are adjusted in position on each of the bolts to bring the plate into a level position as indicated by the gage. The tool plate is then removed for use on another installation with the four bolts providing an accurately level support for the pole.

A removable tool for leveling a vertical structure in a vertically level orientation is also disclosed, the tool including a flat substantially non-bendable material, wherein the tool has a central hole formed in the center thereof that does not extend to or open out to the periphery of the tool, and four slots extending radially away from the hole and spaced from each other evenly about the tool.

DETAILED DESCRIPTION

The device and method of the embodiments disclosed herein has many advantages over this prior art approach. First, the accuracy of the achieved level is greatly improved over the prior art approach which involves the use of a torpedo level to level from one bolt to the next. The use of the flat plate of the tool in contemplated embodiments alone or with a circular level mounted on it allows a complete and accurate leveling in a simple operation, thereby minimizing the possibility of any error between the support points. In addition, the use of the tool disclosed herein allows an "all point" contact, rather than in-line leveling of a bolt circle. This all point contact embodiment has never been achieved by conventional tools or methods.

Further, by pre-leveling the bottom nut prior to pole installation, there is no need to leave a large gap for future adjustment. Recessing the bolts into the concrete allows the pole base direct contact with the concrete base with no resulting gap; or the nuts can be leveled closer to the concrete base, resulting in a smaller gap. By either minimizing the adjustment gap or eliminating it entirely, a much stronger and more structurally sound installation of the pole is obtained. The need for expansion material (dry pack) is also reduced or eliminated. In addition, the poles are automatically pre-plumb with no additional adjustment needed after installation.

Specifically, a removable tool for leveling a vertical structure in a vertically level orientation is disclosed where the tool comprises a flat substantially non-bendable material, wherein the tool has a central hole formed in the center thereof that does not extend to or open out to the periphery of the tool, and four slots extending radially away from the hole and spaced from each other evenly about the tool.

Referring to FIGS. 1-4, a contemplated embodiment is illustrated. Concrete base 11 is preferably circular in configuration and rests on the ground where the pole for a light or other purpose is to be installed. Embedded in the concrete are four bolts 12 *a*-12 *d* with the threaded portions above the surface of the concrete. The bolts are arranged in a circular configuration, equidistant from each other. A nut 17 is threadably attached to each bolt 12 *a*-12 *d* in a position spaced upwardly from the surface of the concrete base.

Figure 1:
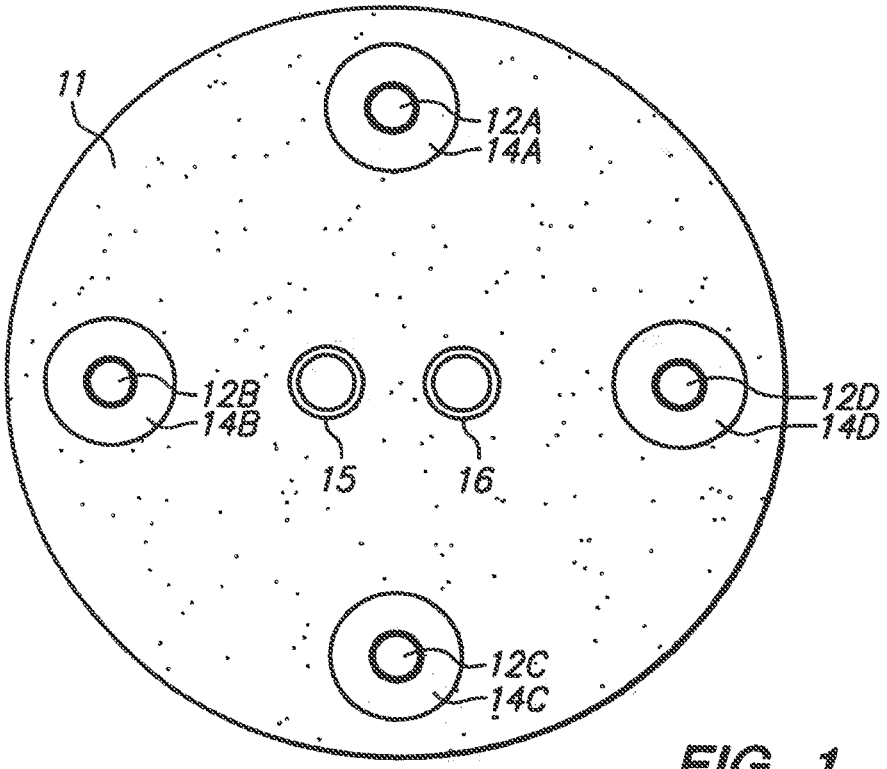
FIG. 1 is a top plan view of a contemplated embodiment with the tool removed.
Figure 2:
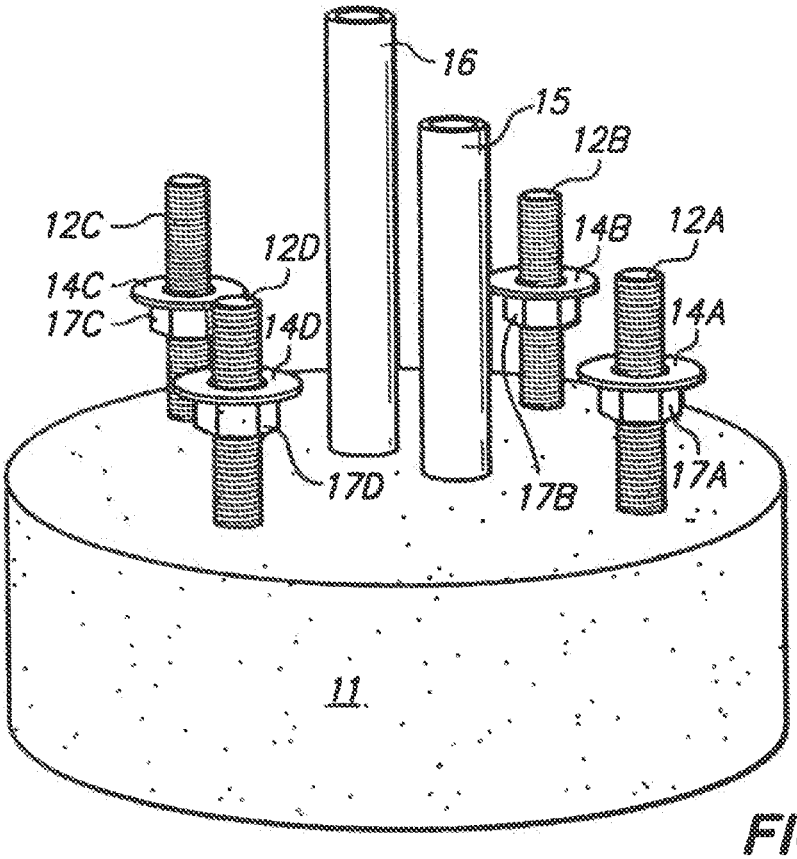
FIG. 2 is side perspective view of a contemplated embodiment with the tool removed.
Figure 3:
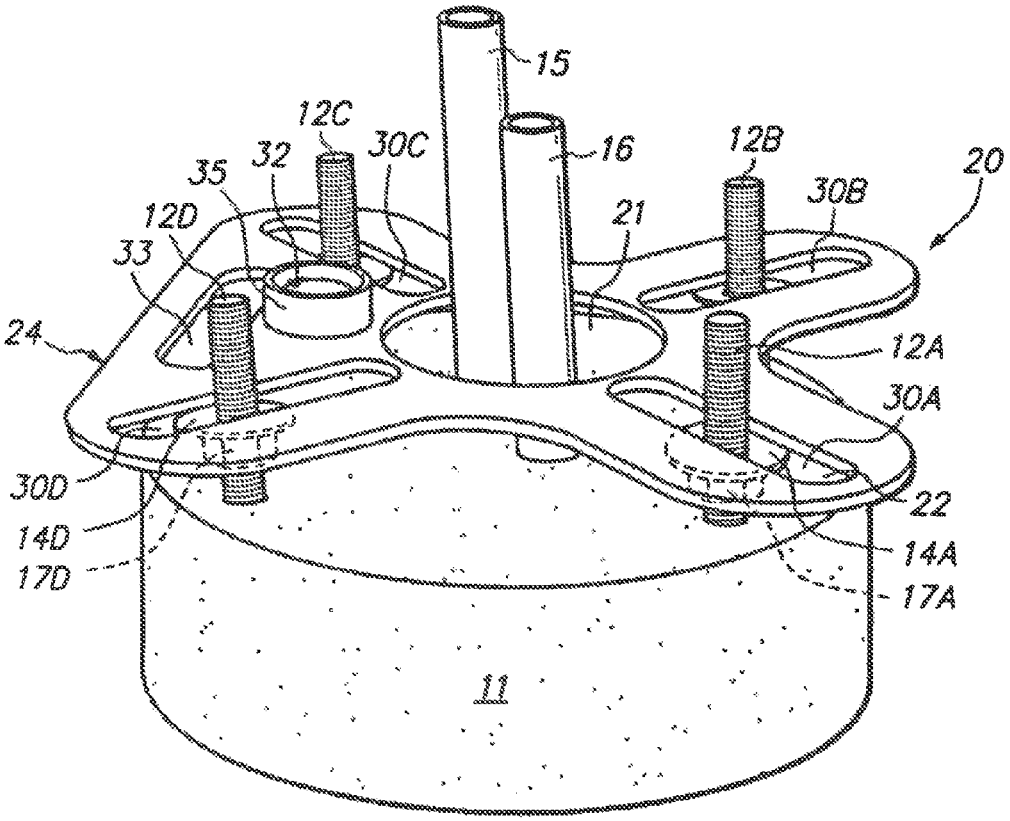
FIG. 3 is a side perspective view of a contemplated embodiment with the tool installed in position.

The bolts may have a lower nut 13 embedded in the concrete to which they are threadably attached, as shown in FIG. 3. On top of each of the nuts 17 *a*-17 *d* is a washer 14 *a*-14 *d*. It is to be noted that while the washers are helpful, they are not essential to make for an operative device. In the center of the concrete base, are a pair of conduits 15 and 16 which run through the base and can be used to carry electrical lines for lights or other devices which may be mounted on the pole.

Figure 4:
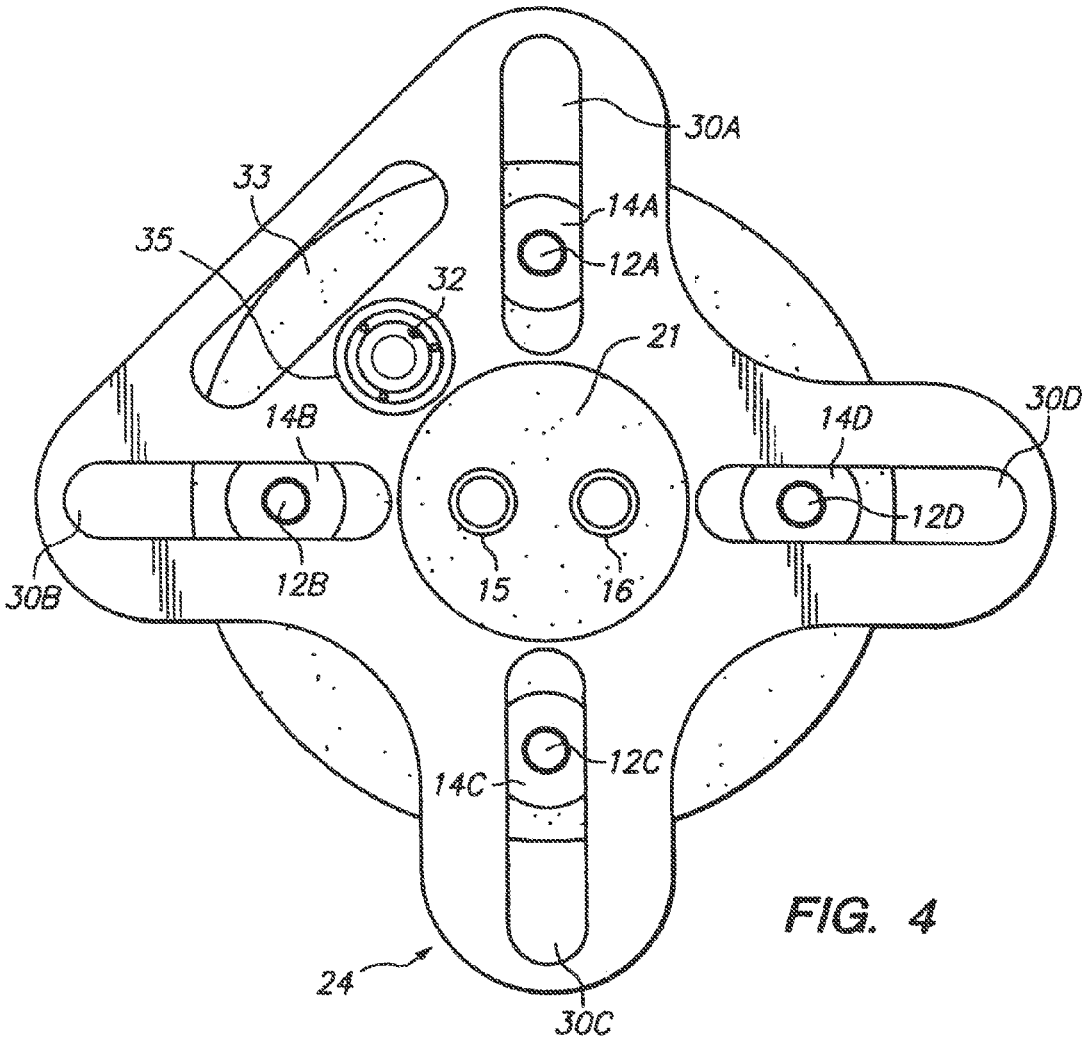
FIG. 4 is a top plan view of a contemplated embodiment with the tool installed in position.

Referring now to FIGS. 3 and 4, the tool 24 used to level the device is illustrated. This contemplated tool is fabricated of a rigid material which may be a sheet of aluminum of about one inch in thickness. The tool has a central aperture 21 which may be round, substantially circular, oval, square or rectangular and through which the conduits 15 and 16 for electrical lines may pass. However, it should be understood that while conduits for electrical lines can be utilized, the tool is not meant to be a permanent installation, but is instead designed to be removable, so the actual electrical lines will not be installed until the tool is removed—if their installation results in a design that doesn't allow easy removal of the tool.

Four slots 30 *a*-30 *d* are formed in the tool. These slots are equally spaced and run from the central aperture 21 to the periphery of the tool. Fitted in each of the slots is one of bolts 12 *a*-12 *d*. The edges of the slots abut against the washers 14 *a*-14 *d* which are directly beneath them. A substantially rectangular slot 33 is formed in the tool to facilitate its handling.

A level 32 is provided, this level being commercially available. A level which may be used is identified as follows: (inventor please give us model and manufacturer). The nuts 17 *a*-17 *d* are each manually adjusted on bolts 12 *a*-12 *d* respectively until accurate leveling of the tool is indicated by level 32. The desired leveling for the pole base is now provided and the tool can be removed for future use.

Figure 5:
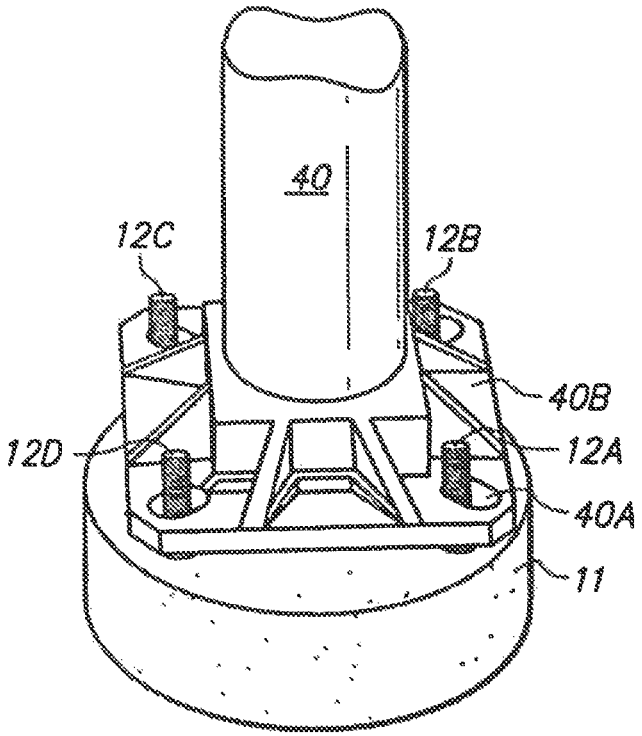
FIG. 5 is a side perspective view showing a contemplated embodiment with a pole installed thereon.

Referring to FIG. 5, the support of a pole 40 on the leveled support is illustrated. The bolts 12 *a*-12 *d* are fitted through apertures 40 *a* formed in the base plate 10 *b* of the pole with the base plate 40 *b* resting on the washers and bolts leveled with the leveling tool.

Figure 6:
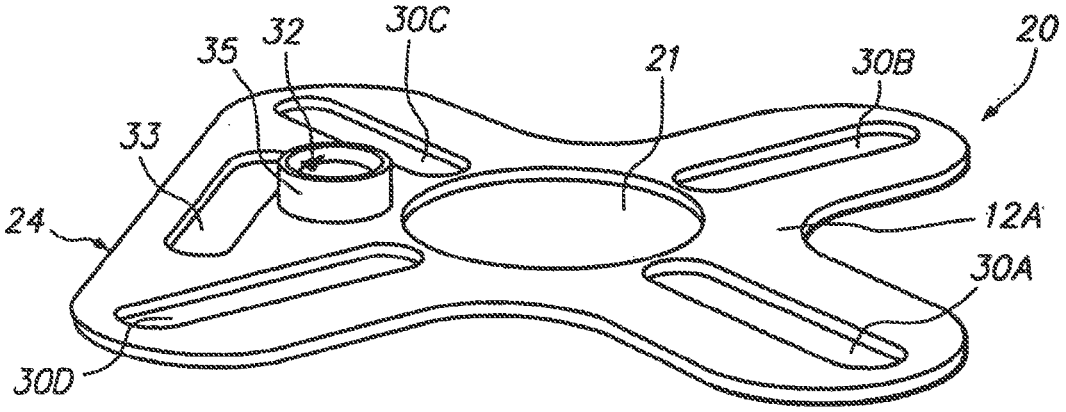
FIG. 6 is a top plan view of an arch which may be employed to support the level.
Figure 7:
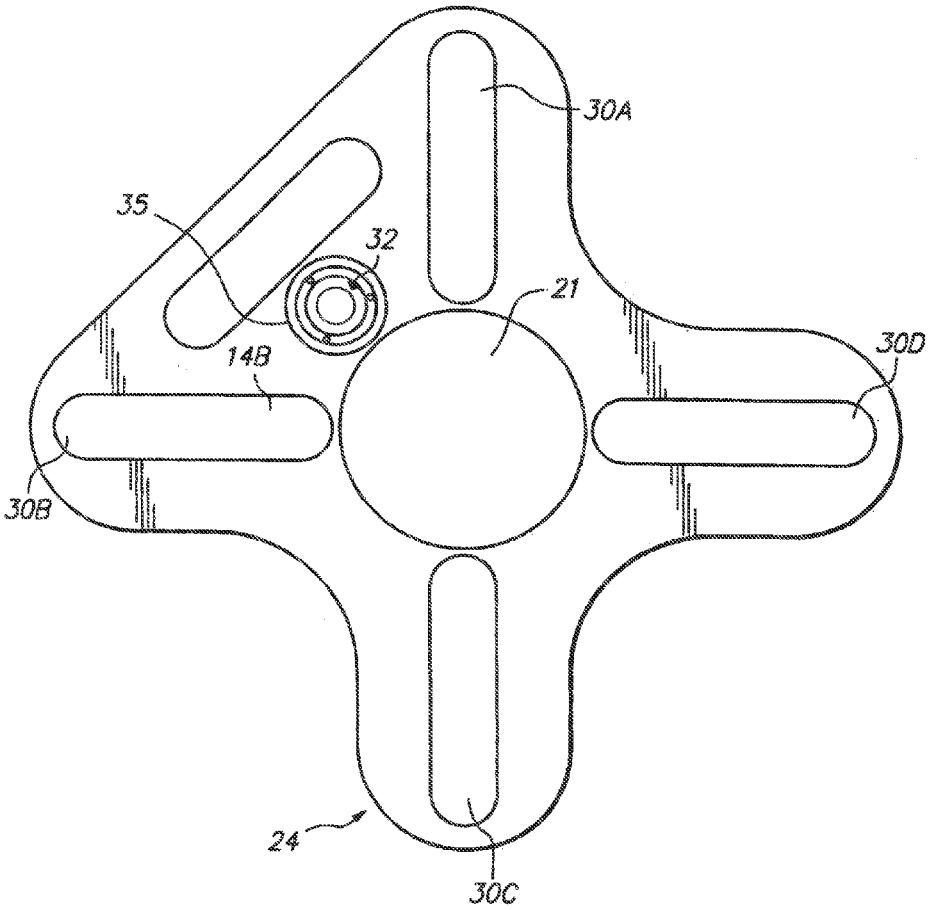
FIG. 7 is a side perspective view of the arch shown in FIG. 6.

Referring now to FIGS. 6 and 7, an alternate structure for balancing the tool 20 is shown. In this instance, the tool 20 is exactly as previously described in conjunction with its balancing except that the leveler 32 is placed on an arch 41 above the tool plate. This provides some simulation of height. It is necessary, however that the top portion of the arch be precisely parallel to the surface of the base tool.

Figure 8:
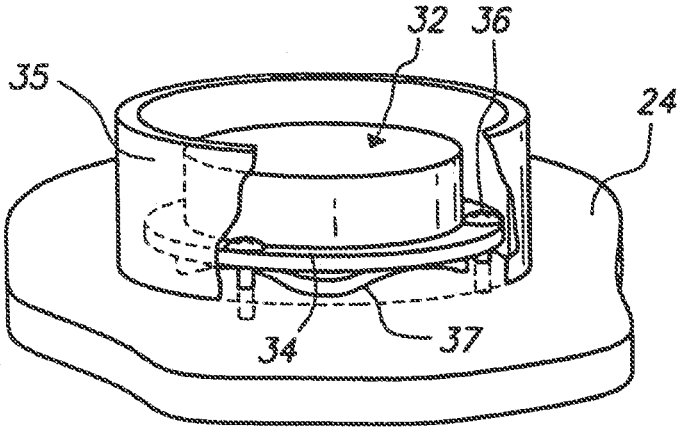
FIG. 8 is a side elevational view of the leveler and its tensioner.
Figure 9:
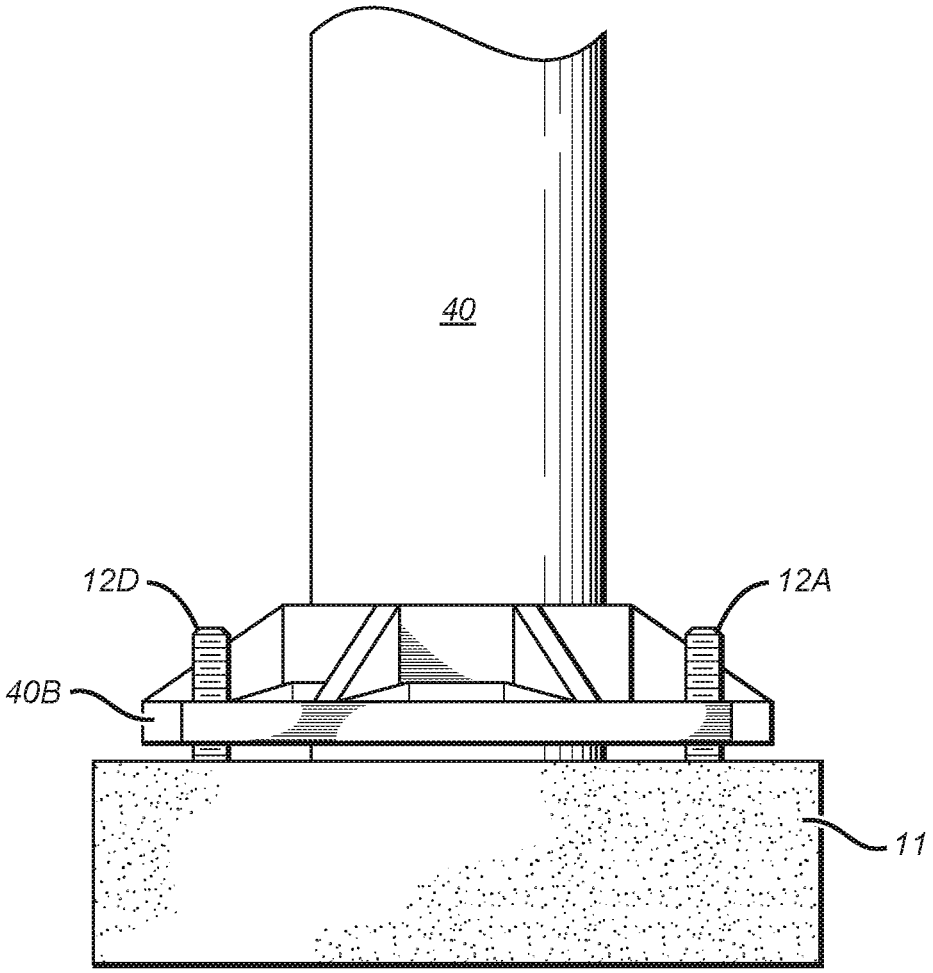
FIG. 9 is another side perspective view showing the contemplated embodiment of FIG. 5.

Referring now to FIG. 8, a stabilizing device for supporting leveler 32 firmly in position is illustrated. The leveler is attached to support plate 34 by means of bolts 36 which threadably engage the plate and are adjusted to bring the level to a level position. Wavy washer 37 abuts against arch 41 and the leveler 32 to tension the leveler firmly in position.

Additional embodiments include a method for providing a level support in a vertical position for a pole comprising the steps of: installing four bolts in a concrete block with the top end of the bolts protruding from the top surface of the block, wherein the bolts are positioned in a circular configuration spaced around the surface of said block; installing a nut on each of the bolts; installing a flat plate of rigid material forming a tool having a central aperture and four slots formed therein, wherein the slots are about equally spaced from each other and extending from the central aperture towards the periphery of the plate; and wherein the flat plate is installed with each bolt fitted into one of the slots and the edges of the bolts abutting against the edges of the slots; installing a leveling gage on the plate; adjusting each of the nuts on its associated bolt to level the plate as indicated by the leveling gage; and removing the flat plate tool for future use, the four nuts having been adjusted to support the pole in a level position.

In other embodiments, a method for mounting a support for a vertical structure in a vertically level orientation is contemplated comprising: providing a solid support base; installing four bolts in said base, wherein the bolts are arranged away from each other in a substantially circular configuration; threadably engaging a nut onto each of said bolts; fabricating a tool of a flat substantially non-bendable material, wherein the tool has a central hole formed in the center thereof that does not extend to or open out to the periphery of the tool, and four slots extending radially away from the hole and spaced from each other evenly about the tool; fitting each of the bolts into a separate one of the slots in the tool with the nuts on the bolts supporting the tool; and supporting a leveling instrument on the tool; whereby each of the nuts is vertically adjusted to bring the tool to a level position, the tool then being removed with the nuts providing a vertically level support for the vertical structure and wherein the vertical structure comprises apertures and is in direct contact with the nuts, wherein the bolts are fitted through the apertures and wherein the tool is removable.

It is important to distinguish the current embodiments over those in the prior art, since the methods, systems and tools disclosed herein could be viewed as a simple solution. The central hole that is disclosed herein is different from Conklin's level, as disclosed in the Background section, which is designed to slide on to the base without needing to detach the electrical wiring. Therefore, it has an opening on the side of the level to allow it to slide on. As a matter of fact, the center hole disclosed herein does not extend to or open out to the periphery of the tool, which is very different from Conklin. The design of the sliding opening of Conklin is specifically designed to slide on to a pole assembly without the need to disconnect any electrical wiring—and therefore, the center aperture must extend out to and open out to the periphery of the tool—it is mandatory.

The method and tool disclosed herein are also distinct in view of the Korfanta reference (U.S. Pat. No. 4,194,237). Korfanta shows a base that can be used to hold a smaller pole. So, the small pole is inserted into the top portion of the device and is bolted into the device. Then, a second set of bolts attaches the device to the ground. In the current application, the bolts go into the leveling device, through the leveling device and to the solid support base or the concrete block support member. The Korfanta device does not inspire one of ordinary skill in the art to modify the device in Conklin to arrive at the current leveling device, for example, because one wouldn't view Korfanta as a device that is applicable to a leveling design, as it is purely meant to retrofit a smaller diameter pole into a hold made for a larger pole. In addition, the device in Korfanta is not removable, unlike the tool recited in the current claims.

Thus, specific embodiments, methods of level adjustment systems, tools and methods for leveling free standing poles and structural columns have been disclosed. It should be apparent, however, to those skilled in the art that many more modifications besides those already described are possible without departing from the inventive concepts herein. The inventive subject matter, therefore, is not to be restricted except in the spirit of the disclosure herein. Moreover, in interpreting the specification and claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. While the subject matter herein has been described and illustrated in detail, this is to be taken by way of illustration and example only and not by way of limitation, the spirit and scope of the contemplated embodiments of the subject matter being determined by the following claims.

The invention claimed is:

1. A method for providing a level support in a vertical position for a pole consisting of the steps of:

providing a pole having a pole base;

installing four bolts in a concrete block with the top end of the bolts protruding from the top surface of the block, wherein the bolts are positioned in a circular configuration spaced around the surface of said block;

installing a nut on each of the bolts;

placing a washer on top of each of the nuts;

installing a flat plate of rigid material forming a tool having a hole formed in the center thereof that does not extend to or open out to the periphery of the tool and four slots formed therein, wherein the slots are about equally spaced from each other and extending from the central hole towards the periphery of the plate; and wherein the flat plate is installed with each bolt fitted into one of the slots and the edges of the bolts abutting against the edges of the slots;

installing a leveling gage on the plate;

adjusting each of the nuts on its associated bolt to level the plate as indicated by the leveling gage;

removing the flat plate tool for future use, the four nuts having been adjusted to support the pole in a level position; and installing the pole, such that the pole base is in direct contact with the concrete block with no resulting gap between the pole base and the concrete block.

2. A method for mounting a support for a vertical structure in a vertically level orientation consisting of:

providing a vertical structure having a structure base;

providing a solid support base;

installing four bolts in said base, wherein the bolts are arranged away from each other in a substantially circular configuration;

threadably engaging a nut onto each of said bolts;

fabricating a tool of a flat substantially non-bendable material, wherein the tool has a central hole formed in the center thereof that does not extend to or open out to the periphery of the tool, and four slots extending radially away from the hole and spaced from each other evenly about the tool;

fitting each of the bolts into a separate one of the slots in the tool with the nuts on the bolts supporting the tool;

supporting a leveling instrument on the tool;

whereby each of the nuts is vertically adjusted to bring the tool to a level position, the tool then being removed with the nuts providing a vertically level support for the vertical structure and wherein the vertical structure comprises apertures and is in direct contact with the nuts, wherein the bolts are fitted through the apertures and wherein the tool is removable; and installing the vertical structure, such that the structure base is in direct contact with the solid support base with no resulting gap between the structure base and the solid support base.

3. The method of claim 2, wherein the tool is fabricated of aluminum.

4. The method of claim 2, wherein the vertical structure is a pole.

5. The method of claim 2, wherein the base structure comprises concrete.

* * * * *